US005295580A

United States Patent [19]

Hicks

[11] Patent Number: 5,295,580

[45] Date of Patent: Mar. 22, 1994

[54] CONTAINER WITH OVERLAPPING FLAP CLOSURE AND NESTING SPACER

[76] Inventor: Stewart W. Hicks, 423 Linda Dr., San Antonio, Tex. 78216

[21] Appl. No.: 962,945

[22] Filed: Oct. 19, 1992

[51] Int. Cl.[5] ..... B65D 75/00

[52] U.S. Cl. ..... 206/588; 206/814; 229/87.02

[58] Field of Search ..... 206/232, 309, 312, 313, 206/444, 521, 588-590, 814, 823, 0.8, 0.81-0.84; 229/87.02, 92.9

[56] References Cited

U.S. PATENT DOCUMENTS

| | | | |
|---|---|---|---|
| 1,032,319 | 7/1912 | Anthony | 206/0.83 |
| 1,213,748 | 1/1917 | Cobel | 229/92.9 |
| 1,235,194 | 7/1917 | Evans | 229/92.9 |
| 2,037,504 | 4/1936 | Drake | 229/92.9 |
| 2,196,801 | 4/1940 | Kreisler | 206/823 |
| 2,561,400 | 7/1951 | Morrell | 206/229 |
| 2,746,667 | 5/1956 | Murphy | 206/588 |
| 3,279,594 | 10/1966 | Worthington, III | 206/62 |
| 3,371,851 | 3/1968 | Silene et al. | 206/0.83 |
| 3,399,824 | 9/1968 | Dodge | 206/0.83 |
| 3,522,907 | 8/1968 | Utterback, Jr. | 229/68 |
| 4,754,880 | 7/1988 | Tehrani | 206/588 |
| 4,763,789 | 8/1988 | Questel et al. | 206/588 |
| 4,890,872 | 1/1990 | Parrotta et al. | 206/823 |
| 5,031,772 | 7/1991 | Woodriff | 206/444 |
| 5,090,561 | 2/1992 | Spector | 206/444 |
| 5,105,941 | 4/1992 | Dolan et al. | 206/823 |
| 5,127,525 | 7/1992 | Hummer | 229/87.02 |

FOREIGN PATENT DOCUMENTS

| | | | |
|---|---|---|---|
| 0000055 | of 1878 | United Kingdom | 206/0.84 |

*Primary Examiner*—Jimmy G. Foster

[57] ABSTRACT

A container for shipping, storing, or displaying articles which has an inner protective flap (10) and outer protective flap (12) that fold to enclose an article. The interior of the container is composed of a nesting spacer (38) which is enclosed by a primary protective layer on both top (46) and bottom (40), and a secondary protective layer on both top (12) and bottom (44). These layers act as protection for the article and as a means of support for rigidity of the container.

2 Claims, 6 Drawing Sheets

CONTAINER WITH OVERLAPPING FLAP CLOSURE AND NESTING SPACER

BACKGROUND

1. Field of Invention

This invention relates to containers, specifically to an improved method for shipping, storing or displaying articles in a nesting area.

2. Discussion of Prior Art

As products are introduced to the consumer the need for improved methods of shipping, storing or displaying these products is felt by both the manufacturer and the consumer. Most find that a box or an envelope will fill this need. Both of these methods have certain advantages. The box provides strength. The envelope provides ease of use. The present invention combines the benefits of both of these methods into an improved method for shipping, storing or displaying articles.

Some previous attempts have been made to facilitate these needs. See U.S. Pat. No. 3,522,907 to E. Utterback, Jr. on Aug. 4, 1970. Utterback lacks the overall strength and protection provided by the double layers glued to the interior spacer which is pre-fit to the exact size of the article. Utterback also lacks the ease of use provided by two flaps as opposed to four and one glue point as opposed to four with Utterback. Another attempt was made with U.S. Pat. No. 3,279,594 to G. Y. Worthington III on Oct. 18, 1966 with the protective envelope. Worthington's invention with its single layer construction lacks the strength and rigidity provided for in the double layer construction glued to the interior spacer provided for in the present invention.

OBJECTS AND ADVANTAGES

Accordingly, besides the objects and advantages of the ease of use and added protection described above, several objects and advantages of my container are:

(a) to provide a means of shipping articles without having to add additional packing material such as peanuts for protection;

(b) to provide a means of shipping articles without having to add additional tapes or glues for securing the container;

(c) to provide a visible space in the interior for labeling or text that is located between the opposing flaps and easily accessible before inspection of the article contained within the second flap;

(d) to provide a container of simple construction and little or no re-tooling for manufacture;

(e) to provide a container which is easy to open with only one adhesive strip securing the outside flap;

(f) to provide a container with a nesting area which secures an object on all sides;

Further objects and advantages are to provide an inexpensive means for shipping, storing or displaying articles. Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

Figure 1A:
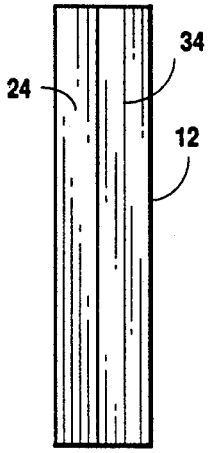
FIG. 1A shows the right elevation with the adhesive flap open.

10 inner protective flap
12 outer protective flap
14 right edge
16 fold
18 fold
20 fold
22 left edge of spacer
24 adhesive strip
26 edge cover of nesting spacer
28 right edge cover of outer protective flap
30 adhesive flap
32 fold (inner protective flap)
34 back
36 nesting area
38 nesting spacer
40 primary bottom protective layer
42 A,B,C wrap around supports
44 secondary bottom protective layer
46 primary top protective layer with hinged inner protective cover

DESCRIPTION—FIGS. 1A TO 4D

A typical embodiment of the adhesive flap of the my container is shown from the right elevation in FIG. 1A. The adhesive flap 30 has an adhesive strip 24 which when licked and folded to the back 34 will secure the container.

Figure 1B:
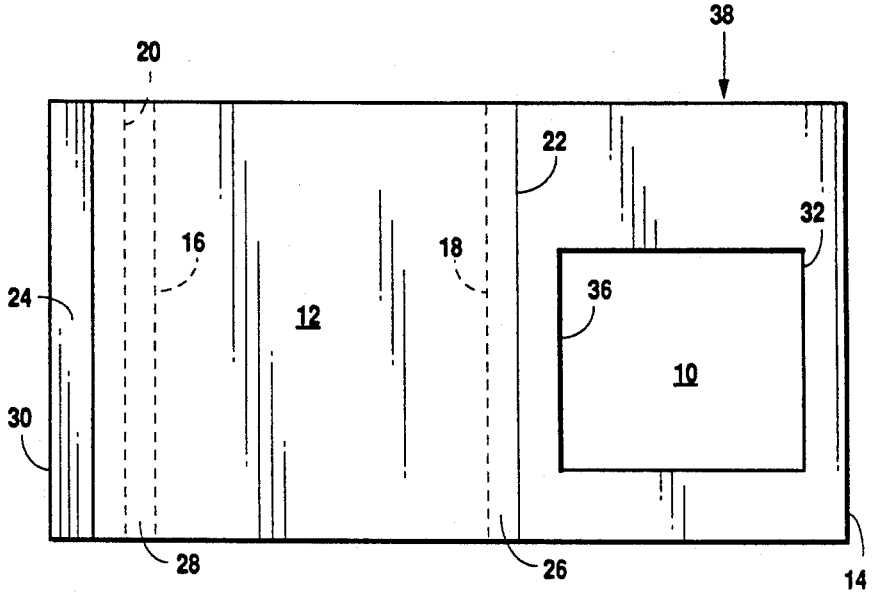
FIG. 1B shows the front view with the outer flap open and the text or label area of the inside surface.

The FIG. 1B shows the container as seen from the front with the outer protective flap 12 open and inner protective flap 10 closed. The text area is located above the inner protective flap and inside outer protective flap 12. The edge cover of the nesting spacer 26 adheres to the left edge of the spacer 26. The right edge cover 28 wraps over the right edge 14 when closing the container. The folds 16,18,20 make a tighter fit of the outer protective flap 12. The fold 32 is on the outer edge of the inner protective flap 10 to make the flap fold to the left from the front.

Figure 1C:
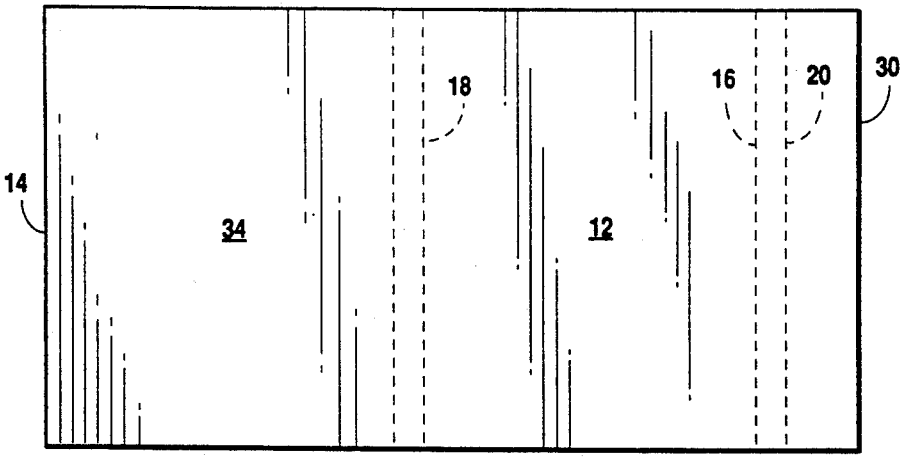
FIG. 1C shows the back view with the outer flap open.

FIG. 1C shows the container from the back with the outer protective flap 12 and adhesive flap 30 open.

Figure 1D:
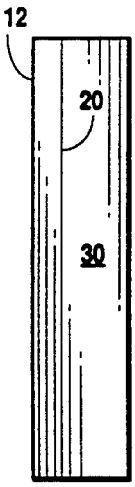
FIG. 1D shows the left elevation with the adhesive flap open.

FIG. 1D shows the left elevation with the outer protective flap 12 closed and the adhesive flap 30 open.

Figure 2A:
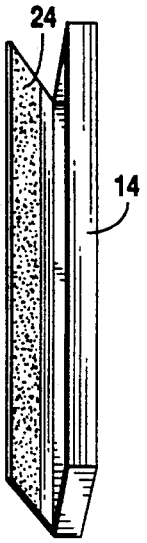
FIG. 2A shows a three dimensional view of the right elevation with the adhesive flap open.

FIG. 2A shows a three dimensional view of FIG. 1A with the adhesive flap 30 open.

Figure 2B:
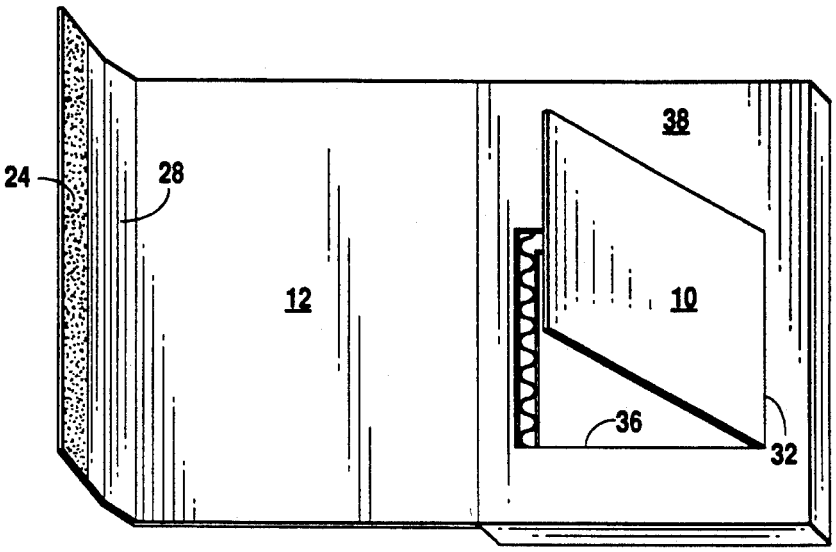
FIG. 2B shows a three dimensional view of the front with the outer and inner flaps open revealing the text or label area and the nesting area shown beneath the inner flap.

FIG. 2B shows a three dimensional view of FIG. 1A with the outer protective flap 12 open. The inner protective flap 10 is open showing the nesting spacer 38 in the interior of the nesting area 36.

Figure 2C:
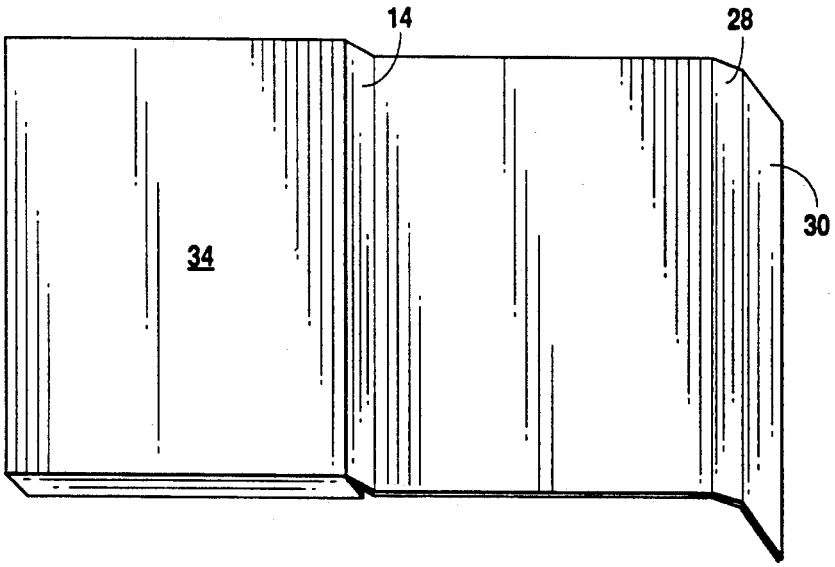
FIG. 2C shows a three dimensional view of the back with the outer flap open.

FIG. 2C shows a three dimensional view of the container from the back with the outer protective flap 12 and the adhesive flap 30 open.

Figure 2D:
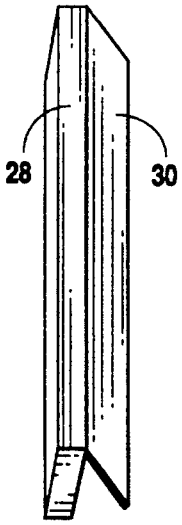
FIG. 2D shows a three dimensional view of the left elevation with the adhesive flap open.

FIG. 2D shows a three dimensional view of the left elevation with the outer protective flap 12 closed and the adhesive flap 30 open.

Figure 3A:
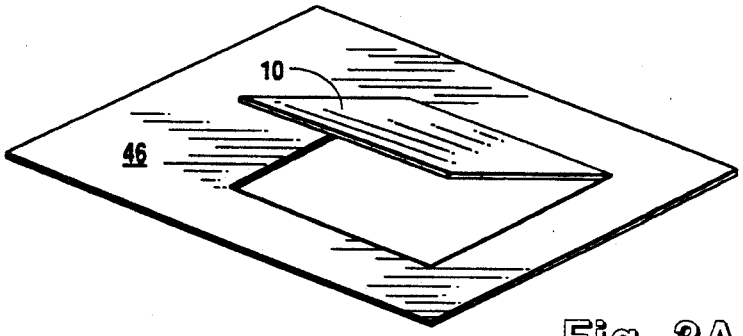
FIG. 3A shows the primary top protective layer with the inner flap partially open.
Figure 3B:
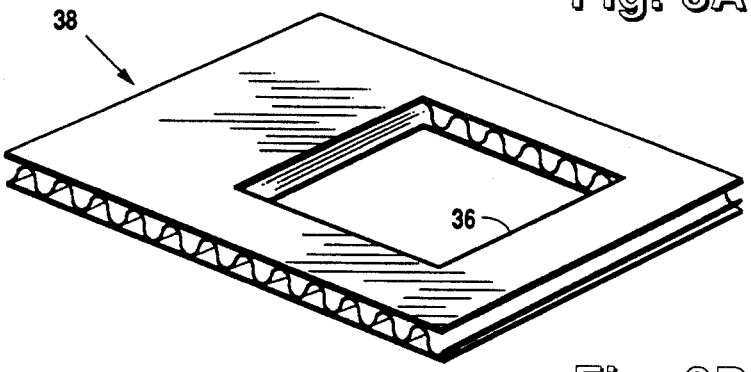
FIG. 3B shows a single spacer with the cut out for the article. (there may be several spacers depending on the depth needed for the article)
Figure 3C:
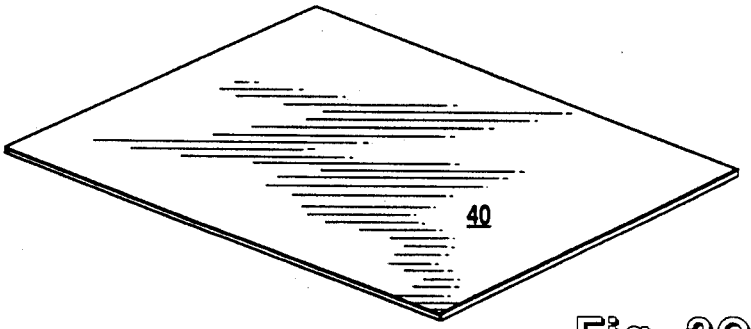
FIG. 3C shows the primary bottom protective layer.
Figure 3D:
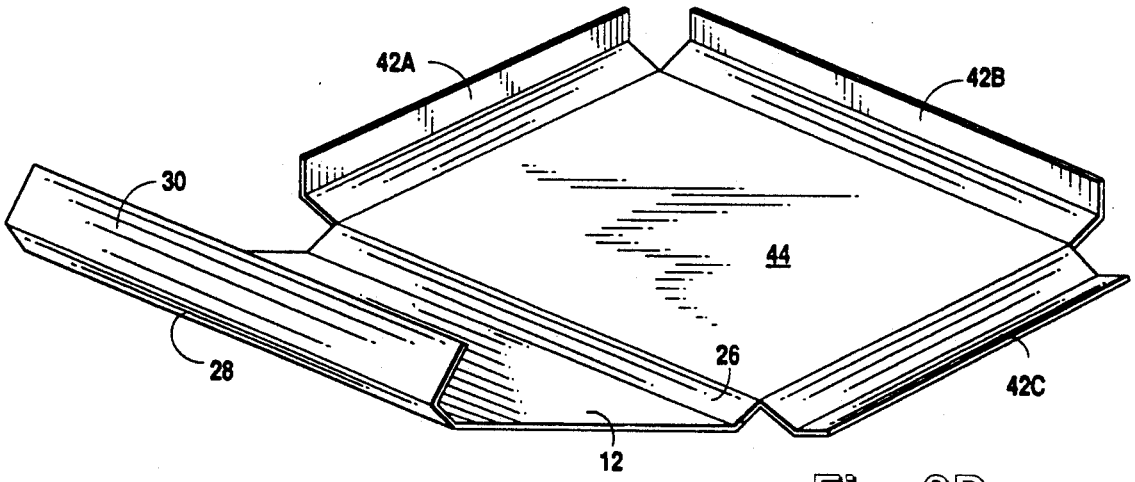
FIG. 3D shows a configuration which contains the secondary bottom protective layer, three wrap around edges to secure FIG. 3D around FIG. 3C and to FIG. 3B, and the top flap which comprises the secondary top protective layer.

FIGS. 3A,3B,3C, and 3D show the component parts of the container before assembly. FIG. 3A shows the primary top protective layer 46 with the hinged inner protective flap 10. FIG. 3B is the nesting spacer 38 for the nesting area 50. FIG. 3C is the primary bottom protective layer 40. FIG. 3D shows a configuration which is comprised of several parts. The outer protective flap 12; the adhesive flap 30; the edge cover of the nesting spacer 26; the right edge cover of the outer protective flap 28; the secondary bottom protective layer 44; and the wrap around supports (42A,42B,42C) which attach to the top of the nesting spacer 38.

Figure 4A:
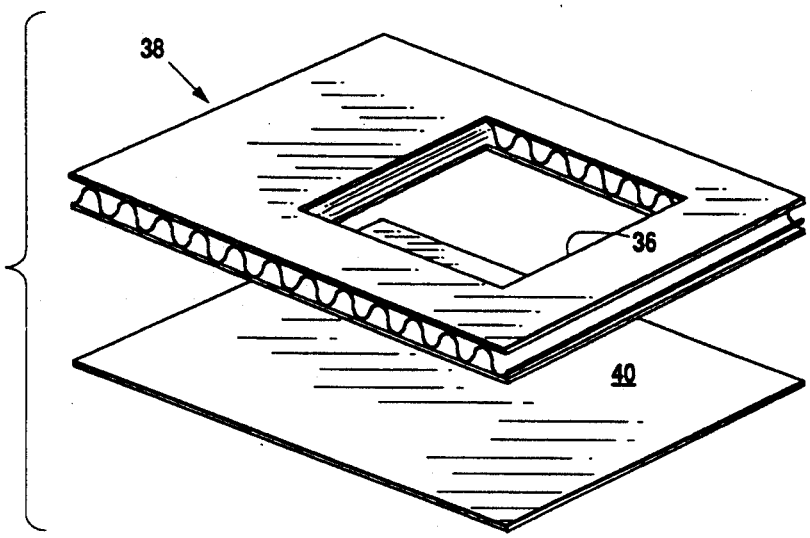
FIG. 4A shows the first stage of assembly with FIG. 3C attached to the back of FIG. 3B.
Figure 4B:
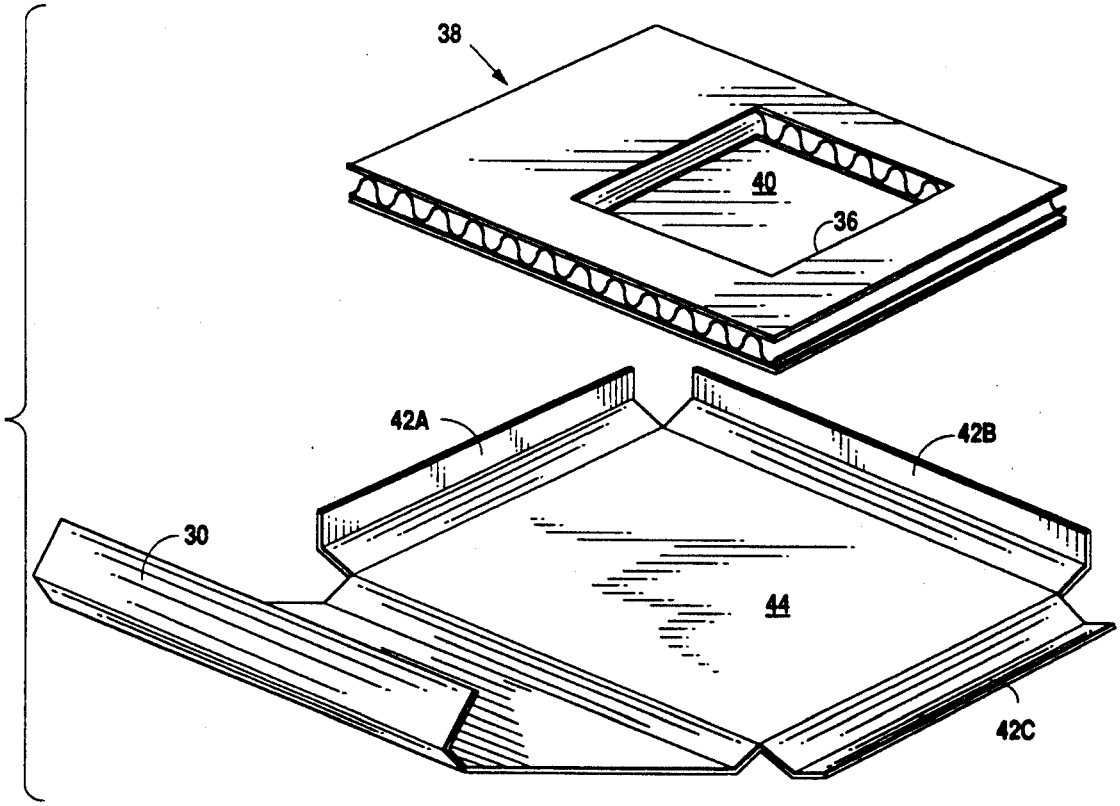
FIG. 4B shows the second stage of assembly with FIG. 3D attached to the back of FIG. 3C and around to the front of FIG. 3B with the wrap around flaps on the top, bottom and right sides.
Figure 4C:
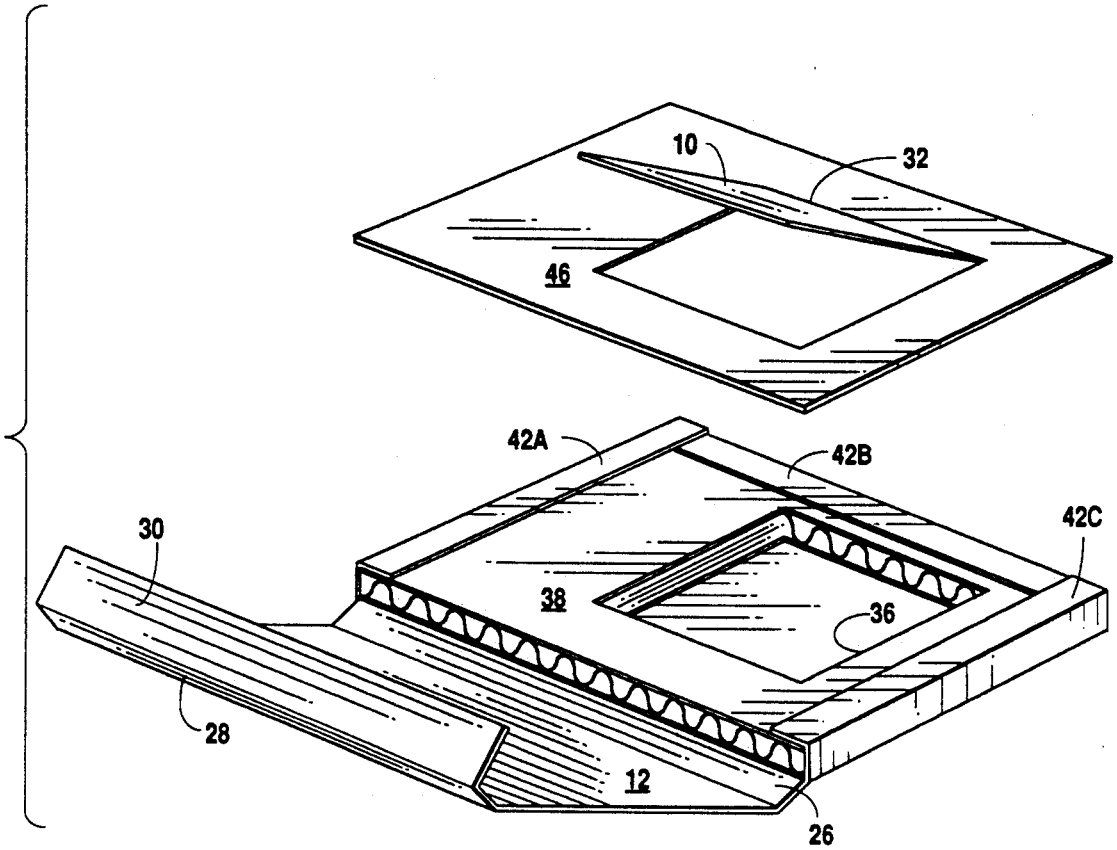
FIG. 4C shows the third stage of assembly with FIG. 3A attached to the front of the combination of FIGS. 3B, 3C, and 3D.
Figure 4D:
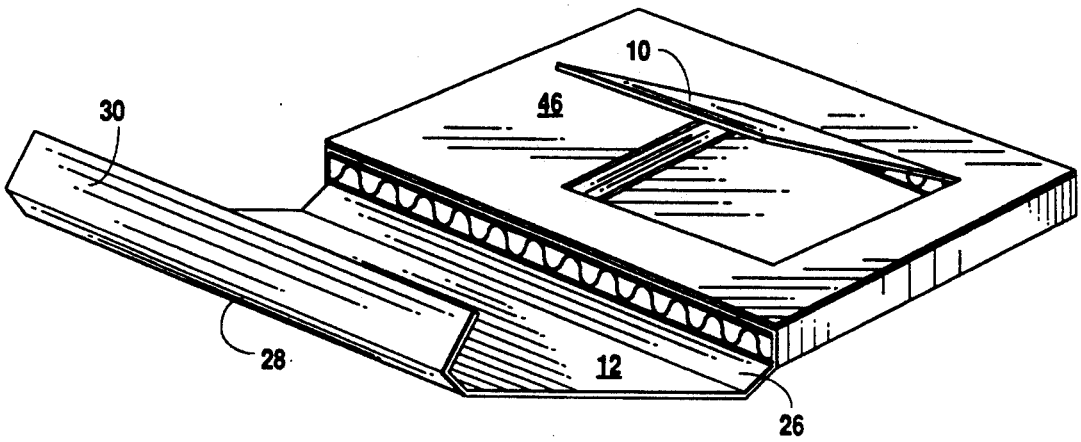
FIG. 4D shows the fourth stage of assembly with the attachment of the folded part of FIG. 3D to the left side of FIG. 3B.

FIGS. 4A, 4B, 4C, and 4D show the assembly of the component parts. FIG. 4A shows the primary bottom protective layer 40 which is glued to the bottom of the nesting spacer 38 in the first stage of assembly. FIG. 4B shows FIG. 3D which is first glued to the combination in FIG. 4A with the secondary bottom protective layer 44 glued to the bottom of the primary bottom protective layer 40; then the wrap around supports (42A,42B,42C) are folded around and glued to the top of the nesting spacer 38. FIG. 4C shows the third stage of assembly with the primary top protective layer with hinged inner protective cover 46 being glued to the combination of components in FIG. 4B. FIG. 4D shows the final stage of assembly with the edge cover of the nesting spacer 26 glued to the edge of the nesting spacer 38.

Figure 5:
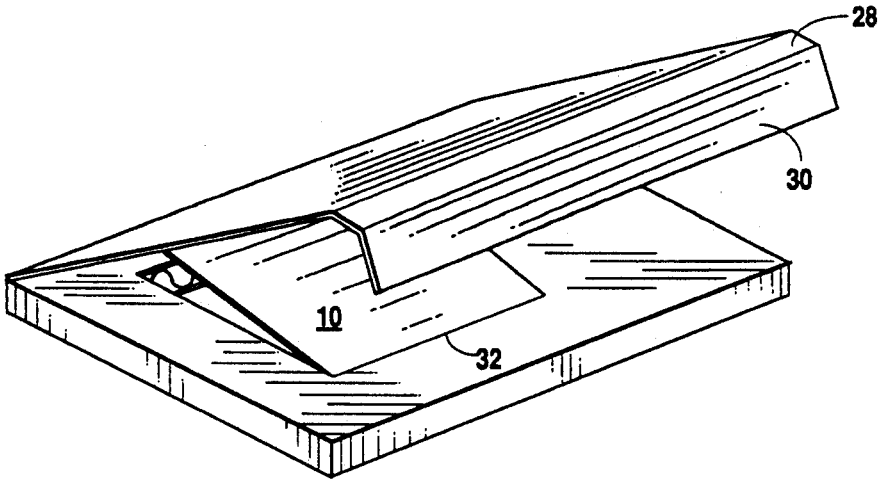
FIG. 5 shows the inner and outer opposing flap design.

FIG. 5 shows the inner and outer opposing flap design.

Figure 6:
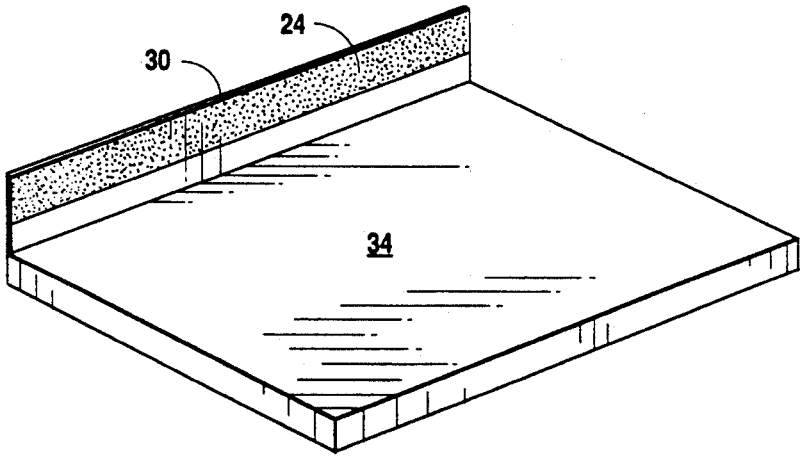
FIG. 6 shows a closed container with the adhesive flap open.

FIG. 6 shows a closed container with the adhesive flap 30 open as seen from the back.

Figure 7:
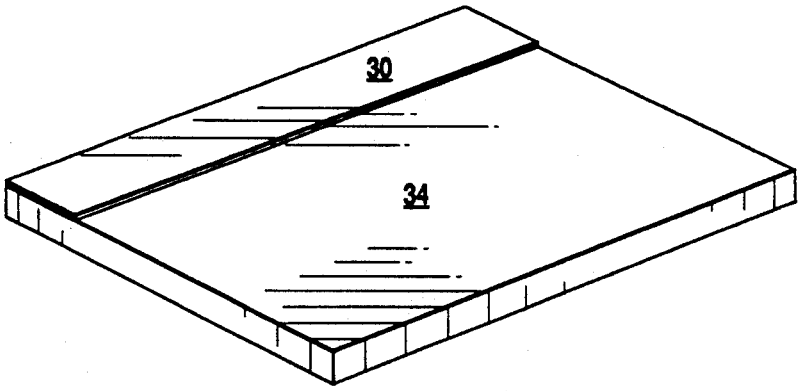
FIG. 7 shows a closed and secured container from the bottom side.

FIG. 7 shows a closed and secured container as seen from the back.

OPERATION—FIGS. 2B, 5, 6, 7

The manner of using my container with the overlapping opposing flaps is very simple. First one takes the article to be shipped, stored, or displayed and inserts the article into the nesting area 50 as shown in FIG. 2B. Then one closes the inner protective flap 10. Third one may add a message or label to the text area. Fourth one closes the outer protective flap 12 as seen in FIG. 5. Finally one licks and secures the adhesive flap 30 as seen in FIG. 6. The container is then ready for shipping as seen in FIG. 7. If one wishes to store or display an article then skip the final step so that the article can be easily retrieved or displayed.

SUMMARY, RAMIFICATIONS, AND SCOPE

Accordingly the reader will see that the container with the overlapping opposing flaps of this invention can easily be used for shipping, storing, or displaying articles affording protection on all sides. Furthermore the container has the additional advantage in that it permits shipping or storing of articles without the addition of packaging material such as peanuts or paper;

it permits shipping of articles without the addition of tapes or glues to secure the container;

it provides a visible space in the interior for text or labeling that is easily accessible before inspection of the article contained within the second flap;

it provides a container of simple construction with little or no re-tooling for manufacture;

it provides a container that is easy to open with only one adhesive strip securing the outside flap;

it provides a container with a nesting area which protects an article on all sides;

it provides an inexpensive means for shipping, storing, or displaying articles;

Although the description above contains many specificities, these should not be construed as limiting the scope of the invention but as merely providing illustrations of some of the presently preferred embodiments of this invention. For example the materials can be constructed of many different colors giving it a broader market appeal. The nesting spacer may be of any shape or depth with the appropriate matching modifications of the other component parts allowing the container to be used for any article, etc.

Thus the scope of the invention should be determined by the appended claims and their legal equivalents, rather than by the embodiment(s) illustrated.

I claim:

1. A container comprising:

a shaped, foldable cover consisting of a back, first and second sides and first and second ends integrally formed with said back, a front integrally formed with said first side, and a flap integral with said front, a spacer approximately conforming to said back in length and width and secured thereto, a shaped opening in said spacer adapted to accommodate an article carried therein, sheet material approximately conforming to said spacer in length and width and secured thereto, a flap-covered opening in said sheet material conforming to and overlying said shaped opening in said spacer, said first and second ends of said cover adapted to at least partially overlie said sheet material, said second side of said cover adapted to at least partially overlie said sheet material, an adhesive on said flap of said cover whereby in folded condition said flap is adapted to pass outwardly of said second side of said cover and secured thereto.

2. A container comprising:

a shaped, multi-foldable cover consisting of a back, first and second sides and first and second ends integrally formed with said back, a front integrally formed with said first side, a flap integral with said front, and a strip of adhesive material on said flap, a spacer approximately conforming to said back in length and width and placed thereon, a shaped cavity in said spacer adapted to accommodate an article carried therein, sheet material approximately conforming to said spacer in length and width and secured thereto, a flap-covered opening in said sheet material conforming to and overlying said shaped cavity in said spacer, said first and second ends and second side of said cover adapted to at least partially overlie said sheet material, in folded condition said flap of said cover adapted to pass outwardly of said second side of said cover and secured thereto.

* * * * *